United States Patent [19]

Yamada et al.

[11] Patent Number: 4,797,353

[45] Date of Patent: Jan. 10, 1989

[54] METHOD FOR DEVELOPMENT OF SILVER HALIDE PHOTOGRAPHIC MATERIALS UTILIZING REDUCED AMOUNTS OF ORGANIC SUBSTANCES

[75] Inventors: Sumito Yamada; Hiroshi Kawasaki; Masaki Satake, all of Kanagawa, Japan

[73] Assignee: Fuji Photo Film Co., Ltd., Kanagawa, Japan

[21] Appl. No.: 94,782

[22] Filed: Sep. 10, 1987

[30] Foreign Application Priority Data

Sep. 10, 1986 [JP] Japan ..... 61-213503
Dec. 15, 1986 [JP] Japan ..... 61-298405

[51] Int. Cl.[4] ..... G03C 1/02; G03C 1/76; G03C 1/495; G03C 5/24

[52] U.S. Cl. ..... 430/434; 430/30; 430/271; 430/536; 430/539; 430/567; 430/639; 430/642; 430/643; 430/644; 430/906; 430/909; 430/911; 430/950; 430/961; 430/966

[58] Field of Search ..... 430/30, 434, 961, 950, 430/536, 539, 567, 639, 643, 644, 642, 966, 906, 909, 911, 271

[56] References Cited

U.S. PATENT DOCUMENTS

| | | | |
|---|---|---|---|
| 3,127,267 | 3/1964 | Frost | 430/30 |
| 3,599,554 | 8/1971 | Aelterman et al. | 430/30 |
| 4,081,280 | 3/1978 | Corluy et al. | 430/30 |
| 4,357,418 | 11/1982 | Cellone | 430/961 |
| 4,460,680 | 7/1984 | Ogawa et al. | 430/434 |

*Primary Examiner*—Mukund J. Shah
*Attorney, Agent, or Firm*—Sughrue, Mion, Zinn, Macpeak, and Seas

[57] ABSTRACT

A method for processing a silver halide light-sensitive material is disclosed, comprising a support having thereon at least one silver halide emulsion layer with an automatic developing machine which comprises developing an imagewise exposed silver halide light-sensitive material, wherein an amount of organic substances remaining in at least one of the emulsion layer or other hydrophilic colloid layers comprising a surface protective layer after said processing with said automatic developing machine, is not more than about 90 wt % of the weight of said organic substances prior to said processing.

17 Claims, No Drawings

METHOD FOR DEVELOPMENT OF SILVER HALIDE PHOTOGRAPHIC MATERIALS UTILIZING REDUCED AMOUNTS OF ORGANIC SUBSTANCES

FIELD OF THE INVENTION

The present invention relates to a method for developing silver halide photographic materials. More particularly, the present invention is directed to a method for developing light-sensitive materials used as X-ray films. The present invention provides an improved technique for development whereby rapid processing, i.e., development with high sensitivity in a short time and drying in a shorter time, can be realized.

BACKGROUND OF THE INVENTION

In recent years, high temperature rapid processing has been in widespread use for development of photographic materials, and is even used in the processing of various light-sensitive materials with an automatic developing machine. Thus, the total processing time has been greatly reduced. To achieve such high temperature rapid processing, a developer with which high sensitivity can be realized in a short time is required, and a light-sensitive material which is excellent in developing properties, which produces no residual color even in such a short processing time, and which is capable of being dried in a short time is also required. In most automatic developing machines, the drying zone is provided in the interior of the machine. If, therefore, the light-sensitive material has poor drying properties, the automatic developing machine must have a high drying capacity. This requirement necessitates the automatic developing machine being increased in size. Furthermore, automatic developing machines usually generate a large quantity of heat, thereby producing a problem in that the temperature of the room where the automatic developing machine has been installed rises undesirably.

For the above reasons, the light-sensitive material to be used in the automatic developing machine is designed so as to increase the drying speed as much as possible. For this purpose, the following method is generally employed: at the coating step, a large amount of a hardener is added to the light-sensitive material to decrease the degree of swelling of the emulsion layer and the surface protective layer during the development-fixing-rinsing process, thus resulting in a reduction of the amount of water contained in the light-sensitive material before commencement of drying. In this method, as the amount of the hardener used is increased, the drying speed can be concomitantly increased. Increasing film-hardening in this manner, however, produces various disadvantages; for example, development speed is reduced, sensitivity is lowered, covering power is lowered, fixing speed of undeveloped silver halide grains is decreased, residual color is deteriorated, and the amount of hypo (i.e., sodium thiosulfate) remaining in the light-sensitive material after processing is increased.

The reduction of the amount of water contained in the light-sensitive material before commencing the drying process can be realized by decreasing the amount of hydrophilic substances such as gelatin, synthetic polymer and hydrophilic low molecular weight substances, coated in the light-sensitive material. However, since the hydrophilic low molecular weight substance is usually added for the purpose of preventing drying and fog formation of silver halide, if the substance is removed;, fog will be formed in the light-sensitive material. Also, if gelatin and synthetic high molecular weight substances which are used as the binder for silver halide grains are removed, the amount of the binder relative to the silver halide grains will be decreased, thereby leading to an increase in the coated silver content. Further, if the amount of the binder is decreased, disadvantages will arise; for example, photographic performance and granularity are reduced, and sensitization and desensitization may be caused by scratches or bending of the light-sensitive material during the handling thereof before the development processing. Even if better drying properties of the light-sensitive material are desired, it is impossible to decrease the amount of the binder because the above problems will arise. Under such circumstances, it has been keenly desired to develop a technique where sufficiently high sensitivity can be obtained using rapid and high temperature development processing, and fixing and rinsing processing steps can be employed without leaving any residual color, thus resulting in excellent image characteristics, and satisfactory drying can be achieved in a short time.

If tabular grains are used, they are orientated in a parallel arrangement relative to the support and thus the surface of the light- ensitive material becomes smooth and glossy. Such characteristics, in the case of light-sensitive materials employed in the medical field, particularly large-sized film sheets for a medical film, give rise to a problem in that the films which have been developed reflect light from ceiling lamps or from windows when a doctor examines them.

A method using gelatin-insoluble polymers together with gelatin for the purpose of inhibiting such surface gloss is disclosed in Japanese patent application (OPI) No. 20731/82 (the term "OPI" as used herein means a "published unexamined Japanese patent application"). It is also known that gloss can be inhibited by using matting agents. These methods, however, fail to sufficiently inhibit gloss of the smooth surface resulting from the use of tabular grains, and furthermore, a considerable increase in haze is caused after the processing.

The present invention is intended to satisfactorily inhibit the formation and amount of surface gloss after processing without an increase in haze.

SUMMARY OF THE INVENTION

One object of the presentinvention is to provide a method for developing photographic materials whereby high covering power can be obtained while maintaining a sufficiently high drying speed, high sensitivity can be achieved in a rapid processing, residual color is decreased in the case of color sensitization, and pressure characteristics are not deteriorated.

Another object of the present invention is to provide a method for developing X-ray photographic materials which exhibit the characteristics described above.

The above and other objects of the present invention can be attained by a method for processing a silver halide light-sensitive material comprising a support having thereon at least one silver halide emulsion layer with an automatic developing machine which comprises developing an imagewise exposed silver halide light-sensitive material, wherein an amount of organic substances remaining in at least one of the emulsion layer or other hydrophilic colloid layers comprising a surface protective layer after said processing with said automatic developing machine is not more than about 90 wt% of the weight of said organic substances prior to said processing.

DETAILED DESCRIPTION OF THE INVENTION

In the method for development-processing a silver halide light-sensitive material comprising a support having thereon at least one silver halide emulsion layer with an automatic developing machine which comprises developing an imagewise exposed silver halide light-sensitive material, an amount of organic substances capable of being washed away (e.g., gelatin, a matting agent, a plasticizer, a polymeric substance, and other organic substances) remaining in the material after carrying out the process, i.e.; development-fixing-rinsing (washing with water)-drying using the automatic developing machine is not more than about 90 wt% of the weight of said organic substances prior to the processing.

Washing away of the organic substances occurs due to physical dissolution or disappearance thereof due to chemical reaction. In more detail, it is preferred that organic substances capable of being washed away or flowing out from the material during the development step be incorporated in an emulsion layer and/or another hydrophilic colloid layer.

The term "organic substances capable of being washed away" as used herein refers to the materials having this ability which are able to achieve the objects of the present invention, as exemplified below.

Where the organic substance capable of being washed away from the material is gelatin, it is preferred to use gelatin of the type that is free from crosslinking due to the hardener. Examples of this type of gelatin include acetylated gelatin and phthalated gelatin. Preferred are those having a low molecular weight. Suitable polymeric organic substances other than gelatin include polyacrylamide as described in U.S. Pat. No. 3,271,158, and hydrophilic polymers such as polyvinyl alcohol and polyvinyl pyrrolidone. Dextran and sugars such as saccharose and pullulan are effective as well as organic substances capable of being washed away. Of these compounds, polyacrylamide and dextran are preferred. Particularly preferred is polyacrylamide. The average molecular weight of the above substances is preferably not more than about 50,000, more preferably not more than 20,000, and most preferably 5,000 to 15,000. An amount of the organic substance such as polyacrylamide, polyvinyl alcohol, polyvinyl pyrrolidone, dextran, saccharose, or pullulan contained in the emulsion layer and/or another hydrophilic colloid layer such as a surface protective layer is preferably 30 wt% or more and more preferably 40 wt% or more based on a total binder of said layer.

An amount of the organic substances washed away from the material by the development processing is preferably about 10 to about 50%, more preferably about 15 to about 30%, based on the total weight of coated organic substances other than the silver halide grains. That is, the amount of the organic substances capable of being washed away remaining in the emulsion layer and/or another hydrophilic colloid layer such as surface protective layer is preferably about 90 to about 50 wt%, and more preferably about 85 to about 70 wt% of the weight of the organic substances prior to the processing.

Processing of X-ray-sensitive materials by the use of a rapid automatic developing machine generally utilizes a hardening at the time of development and a hardening at the time of fixing. The present invention is highly effective even using automatic development processing employing a combination of a developer which will not harden at the time of development and a fixing solution which will not harden or only harden to a small extent at the time of fixing.

The layer in which the organic substances capable of being washed away in the processing of the present invention are to be incorporated may be either an emulsion layer or a surface protective layer. When the total amount of the organic substances contained in all layers is defined, it is preferred that the organic substances be incorporated in both the surface protective layer and the emulsion layer rather than simply being incorporated in only the emulsion layer. More preferably, the organic substances are incorporated in the surface protective layer alone. In the case of a light-sensitive material comprising a multilayer of emulsion layers, when the total amount of the organic substances coated contained in all layers is defined, it is preferred that a larger amount of the organic substances be incorporated in emulsion layers as near as possible to the surface protective layer.

Suitable polymer binders which remain after processing (i.e., residual binders), thereby forming an image pattern in the present invention, effectively include those commonly used in conventional photographic materials. For example, a cross-linked gelatin having an average molecular weight of about 70,000 to about 100,000 (lime-processed or acid-processed), and polyacrylamide, polyvinyl alcohol, polyvinyl pyrrolidone, dextran and the like having a molecular weight of 20,000 or more as described in U.S. Pat. No. 3,514,289, are preferably used. Polymers other than gelatin having a molecular weight of about 20,000 or more may be added independently of the low molecular weight polymers of the present invention, for the purpose of increasing the covering power of silver halide. The low molecular weight polymers to be used in the present invention may have a broad molecular weight distribution, with the high molecular weight component in a small amount and the low molecular weight component remaining completely undissolved in the material during processing.

The amount of the residual binder is preferably about $\frac{1}{3}$ to about 3 times, particularly preferably $\frac{1}{2}$ to 2 times, by weight of the amount of silver coated. The proportion of the gelatin in the binders contained in the light-sensitive material beofore development-processing is preferably 50 to 90 wt% by weight, and more preferably 65 to 80% by weight.

The amount of the residual binder is preferably about 1.5 to about 6 g/m$^2$, more preferably 2 to 4 g/m$^2$ on one side.

In order to make the binder remain in the material, it is conventional to harden it with various cross-linking agents. Various cross-linking agents can be used for the above purpose. Hardeners commonly used in the art such as those described in Research Disclosure, No. 17643, Clause X can be used. Gelatin is particularly preferred as the residual binder. Hardeners preferably used for the gelatin include 2,4-dichloro-6-hydroxy-1,3,5-triazine, compounds containing an active vinyl group, halo-substituted formamidinium salts, and carbamoylammonium salt.

Suitable compounds containing an active vinyl group include compounds as described in Japanese patent application (OPI) Nos. 41221/78, 57257/78, 126124/76, Japanese patent publication No. 13563/74, Japanese patent application (OPI) Nos. 44164/76, 21059/77, U.S. Pat. Nos. 3,490,911, 3,539,644, 362,486, Japanese patent publication No. 35807/75, Japanese patent application (OPI) Nos. 30022/79, 66960/78, Japanese patent publication Nos. 46495/77, 8736/72, U.S. Pat. Nos. 3,635,718, 3,040,720, and West German Pat. No. 872,153.

Suitable compounds having a halo-substituted formamidinium group include compounds as described in Japanese patent application (OPI) Nos. 225148/85 and 240236/86.

Suitable compounds having a carbamoylammonium group include compounds as described in Japanese patent publication Nos. 12853/81 and 32699/83.

In addition, suitable gelatin hardeners to be used in the present invention include polymer hardeners. In particular, the polymer hardeners described in Japanese patent application (OPI) No. 61742/85 produce preferred effects.

In the emulsion layer of the silver halide photographic material of the present invention, known regularly-shaped silver halide grains (for example, spherical grains) having an aspect ratio of less than about 5 can be incorporated. These grains may be used as an upper layer or lower layer of the emulsion layer(s) containing tabular grains having an aspect ratio of not less than about 5, depending on the purpose. Therefore, although the type of silver halide grains are not critical, it is preferred to use tabular grains having an aspect ratio of not less than about 5. In addition, a mixed emulsion can be used, i.e., where about 50% or more of the total projected area of grains in the emulsion layer preferably has a tabular grain having an aspect ratio of not less than about 5. For the preferred tabular grains, the diameter of the corresponding circle is 0.5 μm or more and the thickness is not more than 0.3 μm. It is preferred that grains having an aspect ratio of not less than about 5 constitute at least about 20% by weight of the total amount of silver coated. Of course, the emulsion may be composed of regularly-shaped silver halide grains alone, if desired.

These emulsion layers can be prepared by the methods described in P. Glafkides, *Chimie et Physique Photographique,* Paul Montel (1967), G. F. Duffin, *Photographic Emulsion Chemistry,* The Focal Press (1966), V. L. Zelikman et al, *Making and Coating Photographic Emulsion,* The Focal Press (1964), etc.

Silver halide as used herein may be any of silver bromide, silver iodobromide, silver iodochlorobromide, silver chlorobromide, silver chloride and the like.

Cadmium salts, zinc salts, lead salts, thallium salts, iridium salts or complex salts thereof, rhodium salts or complex salts thereof, iron salts or complex salts thereof and the like may be co-present in the course of formation or physical ripening of silver halide grains. If desired, chemical sensitization can be applied.

For achieving the above-noted chemical sensitization, a gold sensitization method using gold compounds (as described in, for example, U.S. Pat. Nos. 2,448,060, 3,320,069), a sensitization method using metals such as iridium, platinum, rhodium and palladium (as described in, for example, U.S. Pat. Nos. 2,448,060, 2,566,245, 2,566,263), a sulfur sensitization method using sulfur-containing compounds (as described in, for example U.S. Pat. No. 2,222,264), a reduction sensitization method using tin salts, polyamines and the like (as described in, for example, U.S. Pat. Nos. 2,487,850, 2,518,698, 2,521,925) and so on, can be employed alone or in combination with each other.

The silver halide grains to be used in the present invention may, as discussed above, be tabular grains, which are described in detail below.

Tabular silver halide grains may be used, which can be prepared by the methods known in the art or combinations thereof.

Tabular silver halide emulsions can be easily prepared with reference to Cugnac & Chateau, "Evolution of the Morphology of Silver Bromide Crystals During Physical Ripening", *Science et Industrie Photography,* Vol. 33, No. 2, pp. 121–125 (1962), Duffin, *Photographic Emulsion Chemistry,* The Focal Press, New York, pp. 66–72 (1966), and A. P. H. Trivelli & W. F. Smith, *Photographic Journal,* Vol. 80, page 285 (1940), and Japanese patent application (OPI) Nos. 127921/83, 113927/83, 113928/83, 55426/84, 99433/84 and 201235/86.

Alternatively, they can be prepared by forming seed crystals containing therein at least about 40% by weight of tabular grains in a relatively low pBr value condition so that pBr is not more than about 1.3 and then growing the seed crystals by simultaneously adding silver salts and halogen solutions (i.e., halides) while maintaining the pBr value at a similar level.

In the course of grain growth, it is desirable that silver salts and halogen solutions (i.e., halides) be added so as to inhibit the formation of new crystal nuclei.

The size of tabular silver halide grains can be controlled by adjusting the temperature, choosing the type and amount of the solvent, or by controlling the speed of addition of silver salts and halides to be present in the course of the growth of grains. For chemical sensitization, any noble metal sensitization method such as a gold sensitization method, a sulfur sensitization method and so forth can be applied. In particular, the method described in Japanese patent application (OPI) No. 3134/86 is preferably applied.

The light-sensitive materials according to the present invention can contain various compounds for the purpose of preventing fog during preparation, preservation before use, or photographic processing of the light-sensitive materials, or for stabilizing photographic performances. Such compounds include azoles, e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzothiazoles, nitrobenzotriazoles, mercaptotetrazoles (particularly, 1-phenyl-5-mercaptotetrazoles, etc.; mercaptopyrimidines; mercaptotriazines; thioketo compounds, e.g., oxazolinethione, etc.; azaindenes, e.g., triazaindenes, tetraazaindenes (particularly 4-hydroxy-substituted (1,3,3a,7)tetraazaindenes), pentaazaindenes, etc.; benezenethiosulfonic acid, benezenesulfinic acid, benzenesulfonic acid amide, and various other compounds known as antifoggants or stabilizers. Preferred among them are mercaptotetrazoles (particularly, 1-phenyl-5-mercaptotetrazole) and tetrazaindenes (particularly, 4-hydroxy-substituted (1,3,3a,7)tetraazaindenes). For example, the compounds described in U.S. Pat. Nos. 3,954,474, 3,982,947 and Japanese patent publication No. 28660/77 can be used for these purposes.

The silver halide grains to be used in the present invention may also be subjected to spectral sensitization using sensitizing dyes.

The dyes used for this purpose include cyanine dyes, merocyanine dyes, complex cyanine dyes, complex merocyanine dyes, holopolar cyanine dyes, hemicyanine dyes, styryl dyes, and hemioxonol dyes. The particularly useful dyes are cyanine dyes, merocyanine dyes and complex merocyanine dyes.

For these dyes can be applied various nuclei which are usually utilized for cyanine dyes as basic heterocyclic nuclei. That is, such nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei obtained by fusing aliphatic hydrocarbon rings to these nuclei and the nuclei obtained by fusing aromatic hydrocarbon rings to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinolline nuclei, etc. Each of these nuclei may be substituted on the carbon atom of the dye.

For the merocyanine dyes or complex merocyanine dyes can be applied 5-membered or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., as nuclei having a ketomethylene structure.

In more detail, the compounds described in *Research Disclosure,* Vol. 176, No. 17643, page 23 (December, 1978) and U.S. Pat. Nos. 4,425,425 and 4,425,426, can be used.

These sensitizing dyes can be used alone or in combination with each other. Such combinations of sensitizing dyes are often used for the purpose of supersensitization.

Together with the sensitizing dyes, dyes not having a spectral sensitization action by themselves, or substances not substantially absorbing visible light and exhibiting supersensitization effects, may be incorporated in the emulsion. For example, aminostilbene compounds substituted by a nitrogen-containing heterocyclic group (as described, for example, in U.S. Pat. Nos. 2,933,390 and 3,635,721), aromatic organic acid-formaldehyde condensates (as described, for example, in U.S. Pat. No. 3,743,510), cadmium salts, azaindene compounds and the like may be incorporated as well. Combinations as described in U.S. Pat. Nos. 3,615,613, 3,615,641, 3,617,295 and 3,635,721 are particularly useful.

The sensitizing dyes to be used in the present invention are dissolved in water or an organic solvent miscible with water, such as methanol, ethanol, propanol, methyl cellosolve and pyridine, and then added as an aqueous solution or an organic solvent solution ot the silver halide emulsion.

The sensitizing dyes to be used in the present invention may be dissolved with the aid of supersonic vibration as described in U.S. Pat. No. 3,485,634. As the methods for dissolving the sensitizing dyes of the present invention or adding them to the emulsion in the form of a dispersion, the methods described in U.S. Pat. Nos. 3,482,981, 3,585,195, 3,469,987, 3,425,835, 3,342,605, British Pat. Nos. 1,271,329, 1,038,029, 1,121,174, U.S. Pat. Nos. 3,660,101 and 3,658,546 can be employed.

The sensitizing dyes to be used in the present invention are usually added before the emulsion is coated on a suitable support, but may be added at the step of chemical ripening or during formation of the silver halide grains.

In the emulsion layer(s) of the photographic material of the present invention, plasticizers such as polymers and emulsions thereof, can be incorporated to improve its pressure characteristics. For example, a method using heterocyclic compounds is described in British Pat. No. 738,618; using alkyl phthalate, in British Pat. No. 738,637; using alkyl esters, in British Pat. No. 738,639; using polyhydric alcohols, in U.S. Pat. No. 2,960,404; using carboxy alkyl cellulose, in U.S. Pat. No. 3,121,060; using paraffin and carboxylic acid salts, in Japanese patent application (OPI) No. 5017/74; and using alkyl acrylate and organic acids, in Japanese patent publication No. 28086/78.

The photographic emulsion layers or other hydrophilic colloidal layers of the light-sensitive material which can be used in the present invention can furthermore contain various surface active agents for various purposes, for example, as coating aids, as antistatic agents, for improvement of sliding properties, as emulsification and dispersing aids, for prevention of adhesion, for improvement of photographic characteristics (e.g., development acceleration, increase in contrast, and increase in sensitivity), and the like. Examples of useful surface active agents include nonionic surface active agents, such as saponin (steroid type), alkylene oxide derivatives (e.g., polyethylene glycol, polyethylene glycol/polypropylene glycol condensates, polyethylene glycol alkyl ethers or alkylaryl ethers, polyethylene glycol esters, polyethylene glycol sorbitan esters, polyalkylene glycol alkylamines or alkylamides, polyethylene oxide adducts of silicone, etc.), glycidol derivatives (e.g., alkenylsuccinic acid polyglycerides, alkylphenol polyglycerides, etc.), fatty acid, esters of polyhydric alcohols, alkyl esters of sugars, etc.; anionic surface active agents containing an acid group (e.g., carboxyl group, a sulfo group, a phospho group, a sulfate group, a phosphate group, etc.), such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, etc.; amphoteric surface active agents, such as amino acids, aminoalkylsulfonic acids, aminoalkyl sulfates or phosphates, alkylbetaines, amine oxides, etc.; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

These surfactants are described, for example, in R. Oda et al., *Surfactants and Their Application,* Maki Shoten, Tokyo (1964), H. Horiguchi, New Surfactants, Sankyo Shuppan Co., Ltd., Tokyo (1975), *McCutcheon's Detergents & Emulsifiers,* McCutcheon Divisions, MC Publishing Co. (1985), and Japanese patent application (OPI) No. 76741/85, Japanese patent application Nos. 13398/86, 16056/86 and 32462/86.

Suitable antistatic agents include fluorine-containing surfactants or polymers described in Japanese patent application Nos. 249021/85 (corresponding to U.S. patent application Ser. No. 929,021 filed on Nov. 10, 1986)

and 32462/86, nonionic surfactants described in Japanese patent application (OPI) Nos. 76742/85, 80846/85, 80848/85, 80839/85, 76741/85, 208743/83, Japanese patent application Nos. 13398/86, 16056/86 and 32426/86, and electrically conductive polymers or latexes (nonionic, anionic, cationic and amphoteric) described in Japanese patent application (OPI) No. 204540/82 and Japanese patent application No. 32462/86.

Suitable inorganic antistatic agents include ammonium salt, halides, nitrates, perchlorates, sulfates, acetates, phosphates, thiocyanates and the like of alkali metals and alkaline earth metals, and electrically conductive tin oxide and zinc oxide, as well as composite oxides resulting from the doping of the above metal oxides with antimony and the like, as described in Japanese patent application (OPI) No. 118242/82. In addition, various electric charge transfer complexes, $\pi$-conjugated polymers or their doped products, organometallic compounds, intercalated compounds and so forth can be used as the antistatic agents. Examples are TCNQ/TTF, polyacetylene and polypyrrole. These compounds are described in *Science and Industry,* 59 (3), pages 103–111 (1985) and 59 (4), pages 146–152 (1985).

The photographic material of the present invention may include an interlayer, a filter layer, an antihalation layer and so on, if desired.

In the photographic material of the present invention, photographic emulsion layers and other layers are coated on a flexible support such as plastic films commonly used in photographic materials. Useful examples of such flexible supports are films composed of semi-synthetic or synthetic polymers such as cellulose nitrate, cellulose acetate, cellulose acetate butyrate, polystyrene, polyvinyl chloride, polyethylene terephthalate and polycarbonate. The support may be colored with dyes or pigments, if desired.

With regard to the layer construction of the silver halide photographic material which can be used in the present invention, it is preferred to use a support with at least one silver halide emulsion layer on each of both sides of the support as described in Japanese patent application (OPI) Nos. 127921/83, 90841/84, 111934/83 and 201235/86.

The method for coating an emulsion layer, a surface protective layer and so forth on the support is not critical in the present invention. For example, the multilayer simultaneous coating method described in U.S. Pat. Nos. 2,761,418, 3,508,947, 2,761,791 and so on is preferably used.

The developer to be used in the present invention can contain known developing agents. Developing agents which can be used in the present invention include dihydroxybenzenes (e.g., hydroquinone), 3-pyrazolidones (e.g., 1-phenyl-3-pyrazolidone) and aminophenols (e.g., N-methyl-p-aminophenol). These compounds can be used alone or in combination with each other. In general, the developer further contains known additives such as a preservative, an alkali agent, a pH buffer and an antifoggant and, if desired, may contain a dissolution aid, a color controller, a development accelerator (e.g., quaternary salts, hydrazine and benzyl alcohol), a surfactant, a defoaming agent, a hard water-softening agent, a hardener (e.g., glutaraldehyde), a tackifier and so forth.

The fixing solution can be selected from commonly used compositions. Fixing agents which can be incorporated therein include thiosulfuric acid salts, thiocyanic acid salts, and further, organic sulfur compounds which are known to be effective as the fixing agent can also be employed. The fixing solution may contain water-soluble aluminum salts as the hardening agent.

In the method of development with an automatic developing machine in accordance with the present invention, a roller conveyer-type automatic developing machine as described, for example, in U.S. Pat. Nos. 3,025,779, 3,515,556, 3,573,914, 3,647,459 and British Pat. No. 1,269,268 is preferably used.

The development temperature is preferably from about 18° to about 50° C. and particularly preferably from 30° to 45° C. The development time is preferably from about 8 to about 40 seconds, and particularly preferably from about 8 to about 25 seconds.

The time for the total development process from the start of development to fixing, rinsing and drying is preferably from about 30 to about 200 seconds, and particularly preferably from about 40 to about 100 seconds.

There are no special limitations as to various additives, development methods, exposure methods and so forth for the light-sensitive material of the present invention. These can be chosen as desired or necessary, with reference to *Research Disclosure,* Vol. 176, No. 17643 (December, 1978) and *Research Disclosure,* Vol. 184, No. 18431 (August, 1979).

The present invention is described in greater detail with reference to the following examples, which are not to be construed as limiting the scope of the present invention in any manner. Unless otherwise indicated, all parts, percents, ratios and the like are by weight.

EXAMPLE 1

(1) Pebble-like grains (average grain diameter: 0.98 $\mu$m) of silver iodobromide (silver iodide: 3 mol%) were prepared in the presence of ammonia using the double jet method, and when then chemically sensitized with chloroauric acid salt and sodium thiosulfate. After chemical sensitization, an antifoggant, 4-hydroxy-6-methyl-1,3,3a,7-tetraazaindene was added, and 200 mg per mole of the silver halide grains of sensitizing dye (1-I) having the structural formula shown below was added to effect ortho sensitization.

Sensitizing Dye (1-I)

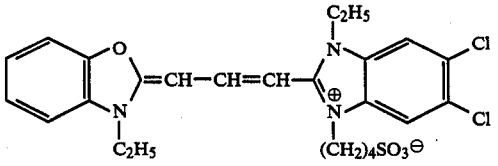

In addition, dodecylbenzene sulfonate as a coating aid and potassium p-vinylbenzenesulfonate as a tackifier were added to prepare the basic formulation for the emulsion layer. The weight ratio of silver to gelatin was 1.35. As the basic formulation for a surface protective layer, a 7 wt% aqueous gelatin solution containing gelatin, polymethyl methacrylate fine grains, saponin, sodium polystyrenesulfonate and so on was prepared. To the emulsion layer and the surface protective layer, gelatin and water-soluble polymer substances were added in the proportions shown in Table 1, and the resulting compositions were coated at the same time on a polyethylene terephthalate support and dried to produce photographic materials 1-1 to 1-11. At this time, the amount of the hardening agent added was changed to prepare samples having different drying speeds.

As the hardening agent, Compound Example V-28 described in Japanese patent application (OPI) No. 117534/86, i.e., a vinyl sulfon-based hardening agent shown below, was used.

Compound Example V-28:

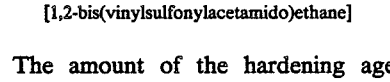

$CH_2{=}CHSO_2CH_2CONH(CH_2)_2{-}(CH_2)_2NH{-}COCH_2SO_2CH{=}CH_2$

[1,2-bis(vinylsulfonylacetamido)ethane]

The amount of the hardening agent added was chosen within the range of 2.0 to 7.0 wt% depending on the amount of gelatin coated, and the addition of the polymer increased the amount of the hardening agent needed to obtain the identical drying speed.

The amount of silver coated was 2.5 g/m$^2$ on one surface, and the silver was coated on both surfaces of the support.

Measurement of Amount of Substance Washed Away by Processing

The amount of the organic substance washed away during the process of development-fixing-rinsing-drying relative to the amount of the coated organic substance prior to the processing (expressed in weight ratio) was measured by the method described below.

A sample was allowed to stand under conditions of temperature 25° C. and relative humidity 10% until the water content of the sample was in equilibrium with the atmosphere, and then the weight of the sample was measured. The sample was subjected to processing from development to drying by the use of an automatic developing machine (Fuji X-ray Processor Model FPM4000 manufactured by Fuji Photo Film Co., Ltd.). Again, the sample was allowed to stand under conditions of temperature 25° C. and relative humidity 10%, and when the water content reached equilibrium, the weight of the sample was measured. By previously measuring the weight of the support, it was confirmed that there was no change of weight in the processing of the support only. The developed silver ratio was measured by subjecting the material to uniform exposure or no subjecting exposure at all. Based on the developed silver ratio and the specific gravity of silver halide, a decrease in the weight of silver halide grains themselves due to development and fixing was calculated. From these values, the weight of the organic substance washed away during the processing was determined. Although the emulsion contained inorganic salts, the amount of the inorganic salts was negligible in comparison with the amount of the organic substance washed away.

In the above situation, the amount of the organic substance washed away was determined by weight measurement. However, the amount could also be estimated by measurement of the film thickness before and after the processing, and the washed-away substances can be quantitatively determined by analyzing the processing solution, if desired.

Method of Measurement of Drying Speed

The automatic developing machine used was a Fuji X-ray Processor Model FPM4000 (produced by Fuji Photo Film Co., Ltd.).

The formulations of the developer and fixing solution were as follows:

| Developer | |
|---|---|
| 1-Phenyl-3-pyrazolidone | 1.5 g |
| Hydroquinone | 30 g |
| 5-Nitroindazole | 0.25 g |
| Potassium bromide | 3.0 g |
| Anhydrous sodium sulfite | 50 g |
| Potassium hydroxide | 30 g |
| Boric acid | 10 g |
| Glutaraldehyde | 5 g |
| Water to make | 1 liter |
| | (The pH was adjusted to 10.20.) |

| Fixing Solution | |
|---|---|
| Ammonium thiosulfate | 200.0 g |
| Sodium sulfite (anhydrous) | 20.0 g |
| Boric acid | 8.0 g |
| Disodium ethylenediaminetetra-acetate | 0.1 g |
| Aluminum sulfate | 15.0 g |
| Sulfuric acid | 2.0 g |
| Glacial acetic acid | 22.0 g |
| Water to make | 1 liter |
| | (The pH was adjusted to 4.20.) |

The sample was passed through the development-fixing-rinsing steps using the above developer and fixing solution in FPM4000. Just before entering the drying zone after squeezing, the film sample was taken out, and the drying speed was measured by the method described below. At the time of this measurement, the drying air of FPM was temporarily stopped.

While blowing hot air onto the thus-removed sample by the use of a commercially available drier, the time required until the temperature of the film surface (as determined by a surface thermometer) reached 30° C., was measured. The development temperature was 35° C. and the temperature of the rinsing water was 14° C.

Measurement of Sensitivity and Dmax

The processing was performed using the same developer and the automatic developing machine as used above, and further the condition that the drying zone was operated normally. Exposure was performed with white light. The value of sensitivity was the logarithmic value of the reciprocal of the exposure amount necessary for obtaining the degree of blackening density corresponding to the fog value of +0.5. The maximum density Dmax was the value at which no increase in density occurred even if a larger amount of exposure was applied. The sensitivity was determined with Sample 1-1 as a standard; when the sensitivity of the other samples were higher than that of Sample 1-1, the relative sensitivity is given a positive value; when lower, it was given a negative value.

Evaluation of Scratching Resistance

The sample was rubbed with a commercially available scrubbing brush under a load of 100 g/cm$^2$ in a dark place and then processed by the use of the same automatic developing machine as used above. After processing, the amount or degree of scratches formed in the sample was evaluated using five stages, from A to E:

A: Almost no scratches were observed.

C: Scratches were clearly observed, but not to the extent rendering the sample unsuitable for practical use.

E: Many scratches were observed, and the sample could not be put to practical use.

B and D were each in an intermediate condition.

Evaluation of Residual Color

The sample which had not been exposed was processed using the same developer and the automatic developing machine as described above, and the level of residual color was determined. These evaluations were rated as follows:

A: Almost no residual color was observed.

C: Residual color was observed, but not to the extent rendering the sample unsuitable for practical use.

E: Residual color was clearly observed, to the extent rendering the sample unsuitable for practical use.

B and D were each in an intermediate condition.

The results of these various evaluations are shown in Table 1, together with the composition of the samples. As the organic substances, polyacrylamide and saccharose having an average molecular weight of 8,000 were used, provided that the used gelatin is a gelatin which is not washed away. Drying properties not causing problems at all in the continuous processing with FPM4000 corresponding to the drying speed of 28 to 29 seconds in the present method. It can be seen from the results of Table 1 that if the amount of the organic substance washed away was in excess of 10%, when the drying speeds were almost equal, high sensitivity and high density could be obtained. Further, scratching resistance and residual color were considerably improved. In the case of Sample 1-9, even though dried in a time of about ½ of that of Comparative Sample 1-1, sensitivity was higher than that for Comparative Sample 1-1, Dmax was high and scratching resistance and residual color were improved considerably.

TABLE 1

| Sample No. | Surface Protective Layer (One Side) Gelatin ($g/m^2$) | Polyacrylamide $\overline{Mw}$ 8000 ($g/m^2$) | Saccharose | Emulsion Layer (One Side) Gelatin ($g/m^2$) | Polyacrylamide $\overline{Mw}$ 8000 ($g/m^2$) | Amount Washed Away by Processing (%) | Drying Speed (seconds) | Sensitivity | Dmax | Scratching Resistance | Evaluation of Residual Color |
|---|---|---|---|---|---|---|---|---|---|---|---|
| 1-1 (Comparison) | 1.3 | — | — | 1.85 | — | 0–2 | 28.3 | 0 | 2.3 | C | C |
| 1-2 (Comparison) | " | — | — | " | — | " | 35.6 | +0.03 | 2.7 | D | C |
| 1-3 (Comparison) | " | — | — | " | 0.50 | 4–5 | 28.0 | +0.01 | 2.4 | C | C |
| 1-4 (Comparison) | " | 0.50 | — | " | — | 6–7 | 28.5 | +0.02 | 2.35 | C | C |
| 1-5 (Invention) | " | — | — | " | 0.70 | 11–12 | 27.8 | +0.03 | 2.6 | B | B |
| 1-6 (Comparison) | " | — | — | " | " | 8–9 | 20.1 | −0.01 | 2.3 | B | C |
| 1-7 (Invention) | " | 0.90 | — | " | — | 14–15 | 28.7 | +0.06 | 2.8 | B | A |
| 1-8 (Invention) | " | " | — | " | — | 13–14 | 19.8 | +0.04 | 2.7 | B | A |
| 1-9 (Invention) | " | " | — | " | — | 10–11 | 14.2 | +0.02 | 2.45 | A | B |
| 1-10 (Invention) | " | — | — | " | 0.90 | 12–13 | 28.0 | +0.02 | 2.5 | C | B |
| 1-11 (Invention) | " | — | 0.90 | " | — | 15–16 | 27.9 | +0.03 | 2.6 | B | B |

If the sensitivity and Dmax are attempted to be increased by conventional techniques such as in Sample 1-2, the drying speed is slowed down to the extent that is unsuitable for practical use, and scratching resistance is reduced by one level. Polyacrylamide is more effective than saccharose.

The remarkable effects of the present invention are apparent from the above-shown results.

EXAMPLE 2

Thick tabular twin grains of silver iodobromide (silver iodide: 3.5 mol%) were formed in the presence of ammonia and potassium thiocyanate using the double jet method. The average grain diameter, calculated as the average diameters of spheres having the same value as individual grains, was 0.78 μm. These grains were subjected to chemical sensitization with chloroauric acid salt and sodium thiosulfate. Thereafter, 400 mg of sensitizing dye (2-I) having the structure shown below, per mol of silver halide grains were added to effect ortho sensitization.

Sensitizing Dye (2-I)

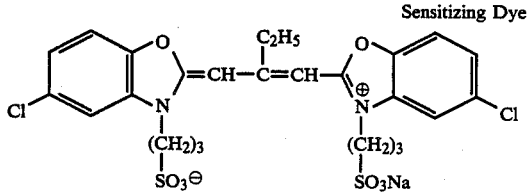

The weight ratio of silver to gelatin in the above emulsion was 1.05.

In the same manner as in Example 1, a coating aid and a tackifier were added, and together with the same type of surface protective layer, a sample having the structure shown in Table 2 was formed. The drying speed was adjusted by controlling the amount of the hardener added. Evaluations were performed in the same manner as in Example 1. The amount of silver coated on each surface was 2.0 $g/m^2$. As polymers to be coated on both surfaces and to be washed away, polyacrylamides having average molecular weights of 40,000, 18,000 and 7,000, respectively, were used, provided that the used gelatin is a gelatin which is not washed away.

It can be clearly seen from Table 2 that polyacrylamide having a low molecular weight is preferred. In accordance with the present invention, the balance among sensitivity, Dmax, scratching resistance and residual color is greatly improved under the conditions where the drying speed is equal or higher to that applied to the comparative samples.

TABLE 2

| Sample No. | Surface Protective Layer (One Side) Gelatin ($g/m^2$) | Polyacrylamide $\overline{Mw}$ 40000 ($g/m^2$) | 18000 ($g/m^2$) | 7000 ($g/m^2$) | Emulsion Layer Gelatin ($g/m^2$) | Amount Washed Away by Processing (%) | Drying Speed (seconds) | Sensitivity | Dmax | Scratching Resistance | Evaluation of Residual Color |
|---|---|---|---|---|---|---|---|---|---|---|---|
| 2-1 (Comparison) | 1.3 | — | — | — | 1.90 | 0–1 | 25.0 | 0 | 3.0 | C | C |
| 2-2 (Comparison) | 0.6 | — | — | — | " | " | 22.5 | +0.03 | 3.05 | E | B |
| 2-3 (Comparison) | 1.3 | 0.8 | — | — | " | 4–5 | 24.5 | +0.01 | 3.2 | B | C |
| 2-4 (Invention) | 1.3 | — | 0.8 | — | " | 12–13 | 25.2 | +0.04 | 3.3 | B | B |
| 2-5 (Invention) | " | — | — | 0.8 | " | 15–16 | 24.8 | +0.07 | 3.4 | B | A |
| 2-6 (Invention) | 0.6 | — | 0.7 | — | " | 13–14 | 22.3 | +0.05 | 3.35 | C | A |
| 2-7 (Invention) | " | — | — | 0.7 | " | 15–16 | 20.1 | +0.09 | 3.4 | C | A |

EXAMPLE 3

Emulsion grains were prepared and coated in the same manner as in Example 1, except that as the polymer (i.e., organic substance) to be washed away, dextrans having average molecular weights of 40,000, 15,000, and 7,000, respectively were used in place of polyacrylamide, provided that the used gelatin is a gelatin which is not washed away.

The results are shown in Table 3. By comparison with Sample Nos 2-1 to 2-3, the effects of the present invention are clearly exhibited.

TABLE 3

| Sample No. | Surface Protective Layer (One Surface) Gelatin ($g/m^2$) | Dextran ($\overline{Mw}$) 40000 ($g/m^2$) | 15000 ($g/m^2$) | 7000 ($g/m^2$) | Emulsion Layer Gelatin ($g/m^2$) | Amount Washed Away by Processing (%) | Drying Speed (seconds) | Sensitivity | Dmax | Scratching Resistance | Evaluation of Residual Color |
|---|---|---|---|---|---|---|---|---|---|---|---|
| 3-1 (Invention) | 1.3 | 0.8 | — | — | 1.90 | 9–10 | 25.0 | +0.06 | 3.5 | B | B |
| 3-2 (Invention) | 1.3 | — | 0.8 | — | " | 13–14 | 24.0 | +0.07 | 3.4 | C | A |
| 3-3 (Invention) | 1.3 | — | — | 0.8 | " | 16–17 | 22.5 | +0.08 | 3.5 | C | A |
| 3-4 (Invention) | 0.6 | — | — | 0.8 | " | 17–18 | 19.0 | +0.10 | 3.5 | C | A |

EXAMPLE 4

30 g of gelatin and 6 g of potassium bromide were added to 1,000 ml of water in a container. An aqueous silver nitrate solution (4 g as silver nitrate) and an aqueous potassium bromide solution containing 0.15 g of potassium iodide were added thereto over a period of 1 minute by the double jet method while stirring. In addition, an aqueous silver nitrate solution (145 g of silver nitrate) and an aqueous potassium bromide solution containing 4.2 g of potassium bromide were added thereto by the double jet method. The addition was performed so that the flow rate at the end of addition was 5 times that at the start of addition. At the end of addition, soluble salts were removed at 35° C. by precipitating. The reaction mixture was raised to 40° C. and 75 g of gelatin were added, and then the pH of the reaction mixture was adjusted to 6.7. With regard to the emulsion thus obtained, it contained tabular grains having a projected area diameter of 0.98 μm and an average thickness of 0.138 μm, and the silver iodide content was 3 mol%. This emulsion was then subjected to chemical sensitization by a combination of gold sensitization and sulfur sensitization. After the end of sensitization, 4-hydroxy-6-methyl-1,3,3a,7-tetraazaindene as an antifoggant was added, and 500 mg per mol of silver halide grains of sensitizing dye (4-I) having the structure shown below was added to effect ortho sensitization.

Sensitizing Dye (4-I)

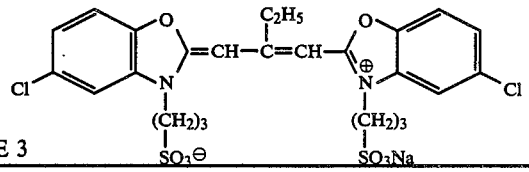

In addition, dodecylbenzene sulfonate as a coating aid and potassium p-vinylbenzenesulfonate as a tackifier were added to prepare a basic formulation for the emulsion layer. The weight ratio of silver to gelatin was 1.05. Separately, a 7 wt% aqueous gelatin solution containing, in addition to gelatin, fine grains of polymethyl methacrylate, saponin, polystyrenesulfonic acid soda and so on, was prepared as a basic formulation for the surface protective layer. Gelatin which is not washed away and water-soluble polymer substances were added to the emulsion layer and the surface protective layer in the proportions shown in Table 4, which were coated on a polyethylene terephthalate support at the same time and dried to form photographic materials 4-1 to 4-11. At this time, the amount of the hardener added was adjusted to prepare samples having different drying speeds.

As the hardening agent, Compound Example V-28 described in Japanese Patent Application (OPI) No.

117534/86, i.e., a vinyl sulfon-based hardening agent, was used. The amount of the hardening agent added was chosen within the range of 2.0 to 7.0 wt% depending on the amount of gelatin coated, and the addition of the polymer increased the amount of the hardening. The amount of silver coated on one surface was 1.9 g/m$^2$, and the silver was coated on both surfaces.

Measurement of Amount of Substance washed away by processing, Measurement of Drying Speed, Measurement of Sensitivity and Dmax, Evaluation of Scratching Resistance, and Evaluation of Residual Color were carried out by the same manner as in Example 1.

The results of these evaluations are shown in Table 4, together with the composition of the samples. As the organic substances to be washed away, polyacrylamide having an average molecular weight of 8,000 and dextran having an average molecular weight of 10,000 were used. Drying properties not causing problems at all in the continuous processing with FPM4000 corresponded to a drying speed of 28 to 29 seconds in the present method. It can be seen from the results of Table 4 that if the amount of the organic substance washed away was in excess of 10%, when the drying speeds were almost equal, high sensitivity and high density could be obtained. Further, scratching resistance and residual color were considerably improved. In the case of Sample 4-9, even though dried in a time of about ½ of that of Comparative Sample 4-1, sensitivity was higher than that for Comparative Sample 4-1, Dmax was high and scratching resistance and residual color were improved considerably.

to the extent that is unsuitable for a practical use, and scratching resistance is reduced by one level as well.

The remarkable effects of the present invention are apparent from the above-shown results.

EXAMPLE 5

All of the potassium iodide contained in the halogen solution which was added by the double jet method in Example 4 was removed. The tabular emulsion thus obtained had a projected area diameter of 0.89 μm and an average thickness of 0.146 μm. This emulsion was subjected to chemical sensitization using a combination of gold sensitization and sulfur sensitization. Then, 500 mg per mol of silver halide grains of sensitizing dye (4-I) were added to effect ortho sensitization. The weight ratio of silver to gelatin was 1.05.

In the same manner as in Example 4, a coating aid and a tackifier were added, and together with the surface protective layer, a sample having the constituent shown in Table 5 was obtained. The drying speed was adjusted by controlling the amount of the hardener added. The evaluations were performed in the same manner as in Example 4. The amount of silver coated was 1.9 g/cm$^2$ on one surface. As the polymers to be coated on both surfaces and to be washed away, polyacrylamides having average molecular weights of 40,000, 18,000 and 7,000, respectively and dextran having average molecular weight of 40,000 and 10,000, respectively, were used, provided that the used gelatin is a gelatin which is not washed away.

It can be seen from Table 5 that the molecular weight of the substance to be washed away is preferred to be

TABLE 4

| | Surface Protective Layer (One Surface) | | | Emulsion Layer (One Surface) | | | | | | | |
|---|---|---|---|---|---|---|---|---|---|---|---|
| Sample No. | Gelatin (g/m$^2$) | Polyacrylamide $\overline{Mw}$ 8000 (g/m$^2$) | Dextran $\overline{Mw}$ 10000 (g/m$^2$) | Gelatin (g/m$^2$) | Polyacrylamide $\overline{Mw}$ 8000 (g/m$^2$) | Amount Washed Away by Processing (%) | Drying Speed (seconds) | Sensitivity | Dmax | Scratching Resistance | Evaluation of Residual Color |
| 4-1 (Comparison) | 1.3 | — | — | 1.81 | — | 0–2 | 26.5 | 0 | 3.42 | C | C |
| 4-2 (Comparison) | " | — | — | " | — | " | 30.6 | +0.03 | 3.85 | D | B |
| 4-3 (Comparison) | " | — | — | " | 0.6 | 4–5 | 26.2 | +0.01 | 3.60 | B | C |
| 4-4 (Comparison) | 1.1 | 0.50 | — | " | — | 6–7 | 26.6 | +0.02 | 3.65 | B | C |
| 4-5 (Invention) | " | — | — | " | 0.80 | 10–11 | 25.9 | +0.03 | 3.9 | B | B |
| 4-6 (Comparison) | " | — | — | " | " | 8–9 | 16.5 | −0.01 | 3.50 | B | C |
| 4-7 (Invention) | 0.8 | 0.80 | — | " | — | 14–15 | 26.0 | +0.05 | 3.95 | B | A |
| 4-8 (Invention) | " | " | — | " | — | 13–14 | 17.3 | +0.04 | 3.86 | B | A |
| 4-9 (Invention) | " | " | — | " | — | 10–11 | 14.2 | +0.02 | 3.70 | A | B |
| 4-10 (Invention) | " | " | — | " | 0.80 | 12–13 | 18.5 | +0.02 | 3.80 | A | A |
| 4-11 (Invention) | " | — | 0.80 | " | — | 15–16 | 23.1 | +0.05 | 3.95 | B | A |

If the sensitivity and Dmax are attempted to be increased by decreasing the amount of the hardener added in accordance with conventional techniques, such as in Sample 4-2, the drying speed is slowed down lower, and that in accordance with the present invention, the balance among sensitivity, Dmax, scratching resistance and residual color is considerably improved while maintaining the drying speed at an equal or higher level.

TABLE 5

| Sample No. | Surface Protective Layer (One Surface) Gelatin (g/m²) | Polyacrylamide (Mw) 40000 (g/m²) | 18000 (g/m²) | 7000 (g/m²) | Dextran (Mw) 40000 (g/m²) | 10000 (g/m²) | Emulsion Layer Gelatin (g/m²) | Amount Washed Away by Processing (%) | Drying Speed (seconds) | Sensitivity | Dmax | Scratching Resistance | Evaluation of Residual Color |
|---|---|---|---|---|---|---|---|---|---|---|---|---|---|
| 5-1 (Comparison) | 1.3 | — | — | — | — | — | 1.81 | 0–1 | 25.0 | 0 | 3.6 | C | C |
| 5-2 (Comparison) | 0.6 | — | — | — | — | — | " | " | 22.0 | +0.03 | 3.65 | E | B |
| 5-3 (Comparison) | 1.3 | 0.8 | — | — | — | — | " | 4–5 | 24.8 | +0.01 | 3.8 | B | C |
| 5-4 (Invention) | 1.3 | — | 0.8 | — | — | — | " | 12–13 | 25.2 | +0.04 | 3.9 | B | B |
| 5-5 (Invention) | " | — | — | 0.8 | — | — | " | 15–16 | 24.7 | +0.07 | 4.05 | B | A |
| 5-6 (Invention) | 0.6 | — | 0.7 | — | — | — | " | 13–14 | 22.3 | +0.05 | 4.0 | C | A |
| 5-7 (Invention) | " | — | — | 0.7 | — | — | " | 15–16 | 19.8 | +0.09 | 4.05 | C | A |
| 5-8 (Invention) | 0.8 | — | — | — | 0.8 | — | " | 13–14 | 21.8 | +0.08 | 4.1 | C | A |
| 5-9 (Invention) | 0.8 | — | — | — | — | 0.8 | " | 16–17 | 18.5 | +0.12 | 4.15 | C | A |

While the invention has been described in detail and with reference to specific embodiments thereof, it will be apparent to one skilled in the art that various changes and modifications can be made therein without departing from the spirit and scope thereof.

We claim:

1. A method for processing a silver halide light-sensitive material comprising a support having thereon at least one silver halide emulsion layer with an automatic developing machine which comprises developing an imagewise exposed silver halide light-sensitive material, wherein an amount of organic substances remaining in at least one of the emulsion layer or other hydrophilic colloid layers comprising a surface protective layer after said processing with said automatic developing machine, is not more than about 90 wt% of the weight of said organic substances prior to said processing, said organic substances being selected from the group consisting essentially of polyacrylamide, polyvinyl alcohol, polyvinyl pyrrolidone, Dextran and gelatin of the type which is free from cross-linking upon reaction with a hardener.

2. The method as claimed in claim 1, wherein said processing comprises the step of developing the imagewise exposed silver halide light-sensitive material with a developing solution, fixing said material with a fixing solution, rinsing said material and drying said material, in said automatic developing machine.

3. The method as claimed in claim 1, wherein the silver halide light-sensitive material is a light-sensitive material suitable as an X-ray film which comprises a support having at least one silver halide emulsion layer on both sides of the support.

4. The method as claimed in claim 1, wherein said organic substances which are selected from the group consisting essentially of pullulan, and saccharose is present in at least one of the emulsion layer or the surface protective layer.

5. The method as claimed in claim 1, wherein said organic substance is polyacrylamide having an average molecular weight of not more than 20,000.

6. The method as claimed in claim 5, wherein said organic substance is polyacrylamide having an average molecular weight of 5,000 to 15,000.

7. The method as claimed in claim 1, wherein said automatic developing machine is a roller conveyer type automatic developing machine.

8. The method as claimed in claim 1, wherein said organic substance is polyacrylamide having a molecular weight of not more than 20,000, and is present in the surface protective layer.

9. The method as claimed in claim 1, wherein said silver halide light-sensitive material comprises a support having at least two silver halide emulsion layers on both sides of the support, said emulsion layer farther from the support containing polyacrylamide as the organic substance capable of being washed away.

10. The method as claimed in claim 1, wherein said silver halide emulsion layer contains a tabular grain having an aspect ratio of 5 or more.

11. The method as claimed in claim 1, wherein 50% or more of the total projected area of grains in said silver halide emulsion layer has a tabular grain having an aspect ratio of 5 or more.

12. The method as claimed in claim 1, wherein an amount of said organic substances remaining in at least one of the emulsion layer or another hydrophilic colloid layer is from about 90 to about 50 wt% of the weight of said organic substances prior to said processing.

13. The method as claimed in claim 1, wherein said organic substance is dextran having an average molecular weight of not more than 20,000.

14. The method as claimed in claim 1, wherein an amount of said organic substance which are selected from the group consisting essentially of polyacrylamide, polyvinyl alcohol, polyvinyl pyrrolidone, dextran, pullulan and saccharose in the surface protective layer is 30 wt% or more based on a total binder of said layer.

15. The method as claimed in claim 1, wherein said organic substances is low molecular weight gelatin free from cross-linking.

16. The method as claimed in claim 1, wherein said organic substances have an average molecular weight of not more than about 50,000.

17. The method as claimed in claim 1, wherein an amount of said organic substance remaining in at least one of the emulsion layer or another hydrophilic colloid layer is from about 85 to about 70 wt% of the weight of said organic substances prior to said processing.

* * * * *